US012071763B2

(12) United States Patent
Robinson et al.

(10) Patent No.: US 12,071,763 B2
(45) Date of Patent: Aug. 27, 2024

(54) DRYWALL INSERTS AND METHODS

(71) Applicants: Kelby Robinson, Daleville, AL (US); Frank Robinson, Daleville, AL (US)

(72) Inventors: Kelby Robinson, Daleville, AL (US); Frank Robinson, Daleville, AL (US)

( * ) Notice: Subject to any disclaimer, the term of this patent is extended or adjusted under 35 U.S.C. 154(b) by 0 days.

(21) Appl. No.: 17/388,928

(22) Filed: Jul. 29, 2021

(65) Prior Publication Data

US 2023/0037184 A1 Feb. 2, 2023

(51) Int. Cl.
*E04C 2/30* (2006.01)
*E04C 2/04* (2006.01)

(52) U.S. Cl.
CPC ..... *E04C 2/30* (2013.01); *E04C 2/043* (2013.01)

(58) Field of Classification Search
CPC ..... E04C 2/30; E04F 11/163; E04F 13/0733; E04F 19/0495; E04F 19/028; E04F 2013/063; E04F 11/166; E04F 13/045
USPC ..... 52/287.1, 288.1
See application file for complete search history.

(56) References Cited

U.S. PATENT DOCUMENTS 3,038,276 A * 6/1962 Butler ..... E04F 13/0803 52/366
4,704,837 A * 11/1987 Menchetti ..... E04C 2/043 52/273
4,719,732 A * 1/1988 Bernard ..... E04F 13/068 52/287.1
4,763,455 A * 8/1988 Schneller ..... E04F 13/06 52/649.1
5,442,886 A * 8/1995 Lacobelli ..... E04F 13/06 52/287.1
5,505,032 A * 4/1996 Wasserman ..... E04F 13/06 52/287.1
5,604,001 A * 2/1997 Schold ..... E04F 13/06 52/287.1
5,729,934 A * 3/1998 Ochoa ..... E04G 21/18 33/483

(Continued)

FOREIGN PATENT DOCUMENTS

CN 209538569 U 10/2019
CN 210002748 U 1/2020

(Continued)

OTHER PUBLICATIONS

Gibralter Building Products, Paper-Faced Inside Drywall Corner Bead, Internet https://www.homedepot.com/p/Gibraltar-Building-Products-1-in-x-10-ft-Paper-Faced-Inside-Drywall-Corner-Bead-70088/100356050?source=shoppingads&location, Mar. 19, 2021, pp. 1-7, Home Depot, United States.

*Primary Examiner* — Brian E Glessner
*Assistant Examiner* — Adam G Barlow
(74) *Attorney, Agent, or Firm* — Dennen IP Law, LLC

(57) ABSTRACT

A corner drywall section has a drywall corner extending vertically from a floor to a ceiling. Further, the corner drywall section has a first wing extending a first side of the drywall corner at a first angle such that the first wing extends horizontally to a first stud, the first wing extending vertically from the floor to the ceiling and a second wing extending from a second side of the drywall corner at a second angle such that the second wing extends horizontally to a second stud, the second wing extending vertically from the floor to the ceiling, wherein the drywall corner, the first wing, and the second wing are a unitary piece of drywall.

15 Claims, 3 Drawing Sheets

(56) References Cited

U.S. PATENT DOCUMENTS

| | | | | |
|---|---|---|---|---|
| 5,934,034 | A * | 8/1999 | Yahiro | E04F 13/06 52/287.1 |
| 6,447,872 | B1 | 9/2002 | Larson | |
| 6,539,680 | B2 * | 4/2003 | Kunz | E04F 13/068 52/287.1 |
| 6,758,017 | B2 * | 7/2004 | Young | E04F 19/022 52/287.1 |
| 7,607,269 | B2 | 10/2009 | Klein | |
| 8,707,640 | B2 * | 4/2014 | Wright | E04F 17/08 52/287.1 |
| 8,898,976 | B2 | 12/2014 | Rosenthal et al. | |
| 9,303,413 | B2 | 4/2016 | Koenig, Jr. et al. | |
| 9,388,582 | B1 * | 7/2016 | Smythe | E04F 13/068 |
| 10,047,524 | B2 | 8/2018 | Smythe | |
| 2001/0039775 | A1 * | 11/2001 | Smythe, Jr. | E04F 13/068 52/287.1 |
| 2003/0056453 | A1 * | 3/2003 | Young | E04F 19/022 52/287.1 |
| 2006/0117685 | A1 * | 6/2006 | Kenessey | E04F 13/06 52/287.1 |
| 2012/0167498 | A1 * | 7/2012 | Wright | E04F 17/04 52/287.1 |
| 2012/0247048 | A1 * | 10/2012 | Kauffman | E04C 2/043 52/578 |
| 2015/0284543 | A1 * | 10/2015 | Hargrove | C04B 26/16 523/122 |
| 2017/0314275 | A1 | 11/2017 | Rosenthal et al. | |
| 2019/0017280 | A1 | 1/2019 | Mineo | |
| 2019/0112818 | A1 * | 4/2019 | Woo | E04B 2/7457 |
| 2019/0211549 | A1 * | 7/2019 | Moscovitch | E04B 1/35 |
| 2021/0355692 | A1 * | 11/2021 | Jöneman | E04F 13/06 |

FOREIGN PATENT DOCUMENTS

| | | | |
|---|---|---|---|
| GB | 2573009 | A | 10/2019 |
| WO | WO 03/076732 | A1 | 9/2003 |

* cited by examiner

FIG. 5
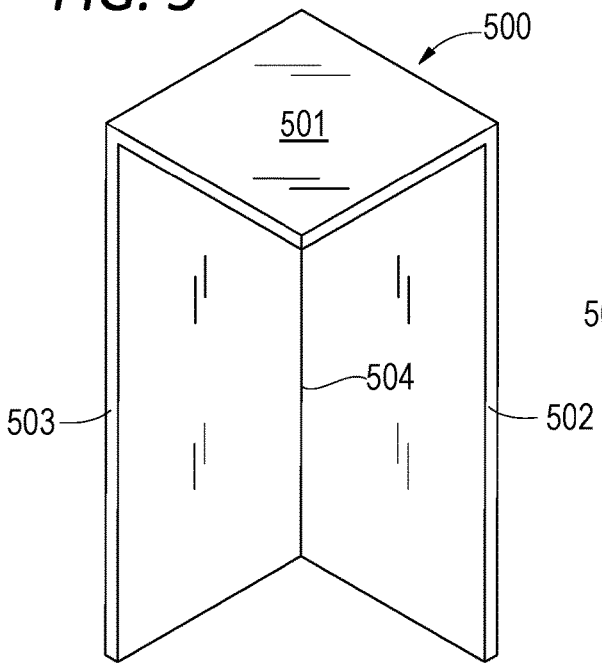
FIG. 6
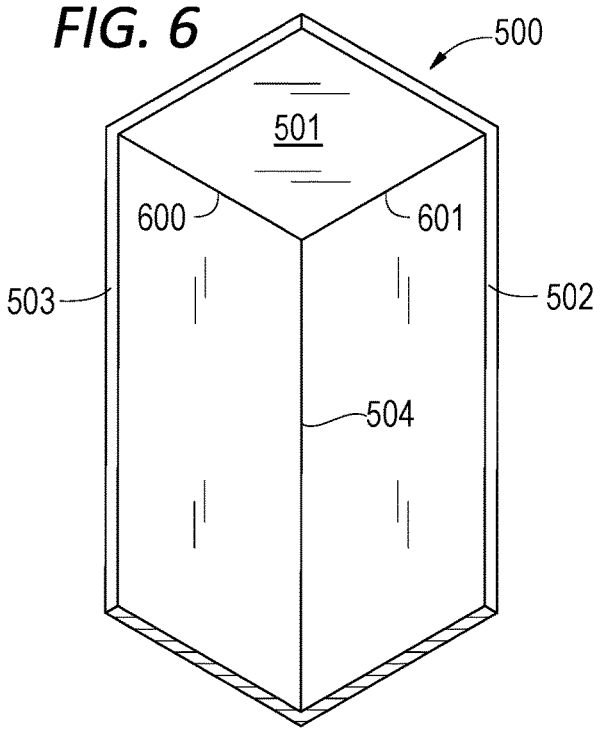
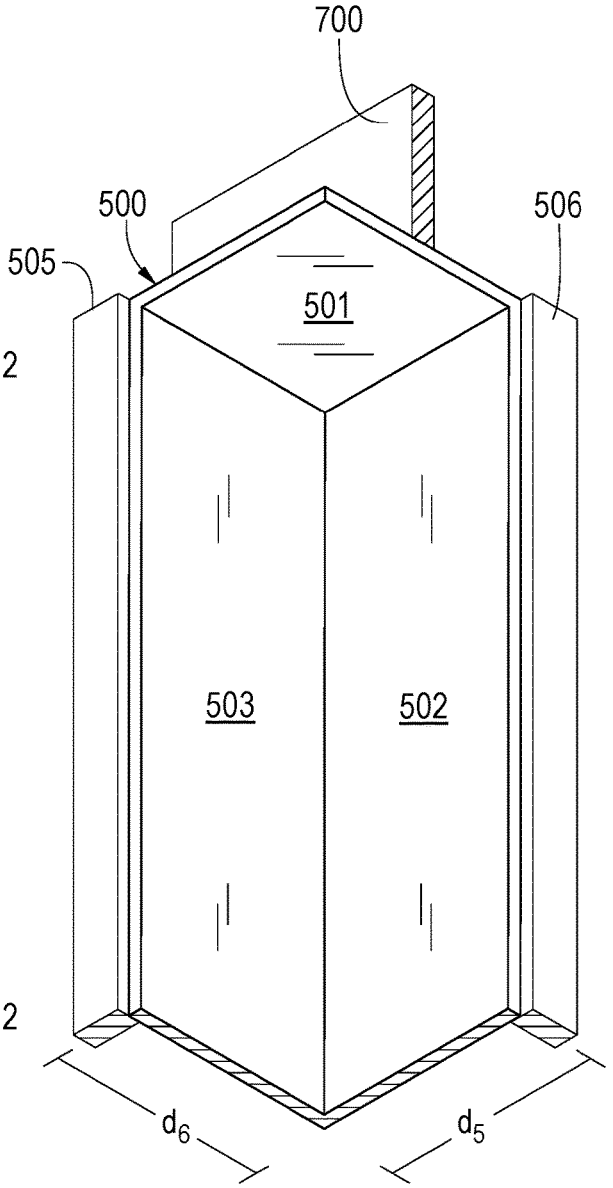
FIG. 7

DRYWALL INSERTS AND METHODS

BACKGROUND

Drywall, often referred to as wallboard, plasterboard, sheetrock, or just "rock," revolutionized how walls and ceilings are covered. Before the 1950s, when drywall became popular, it took days for lather and plasterers to create a foundation for paint or wallpaper.

Today, drywall is in widespread use. To install drywall, first the ceiling is measured, and a piece (or pieces) of drywall is cut to cover the ceiling. The ceiling drywall extends from one side of a room to the other and meets the corners and edges of the room Wall drywall is similarly installed. The length and width of the room is measured. Then drywall is cut such that drywall will cover the walls of the room. In this regard, at least two (probably four) pieces of drywall are cut to begin installing the drywall on the walls. Typically, installation of drywall on the walls begins in the corner. Thus, the installer must ensure that the piece of drywall extending from the corners exhibit a width needed to reach a stud in the wall.

BRIEF DESCRIPTION OF THE DRAWINGS

The disclosure can be better understood referencing the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 5 is a top perspective view of an exemplary corner ceiling insert in accordance with an embodiment of the present disclosure.

FIG. 6 is a bottom perspective view of the exemplary corner ceiling insert of FIG. 5.

FIG. 7 is a top perspective view of the exemplary corner ceiling insert installed.

DETAILED DESCRIPTION

The present disclosure describes drywall inserts that may be used in the drywall process. The drywall inserts fit within an inner corner, fit around an outer corner, and fit in the ceiling corners. The drywall inserts eliminate the need to mud a corner where two drywall wall pieces meet or to mud a ceiling corner where the ceiling drywall and the wall drywall meet the ceiling in a corner.

Figure 1:
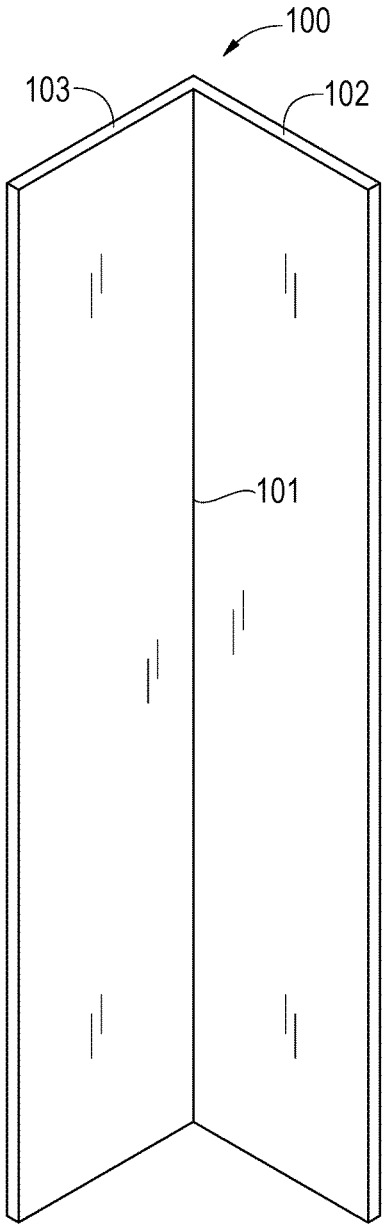
FIG. 1 is a perspective view of an exemplary inner corner drywall insert in accordance with an embodiment of the present disclosure.

FIG. 1 is a perspective view of an inner corner drywall insert 100 in accordance with an embodiment of the present disclosure. The inner corner drywall insert 100 is made of paper-wrapped gypsum. However, it could be made of other materials in other embodiments.

The inner corner drywall insert 100 comprises two wings, including wing 102 and wing 103. The wings 102 and 102 extend at a right angle from a corner 101 of the inner corner drywall insert 100. Note that while the wings 102 and 103 extends ninety degrees from the corner 101, this is merely exemplary. The wings 102 and 103 could extend from the corner 101 at other angles in other embodiments where a corner dictates a different angle.

Figure 2:
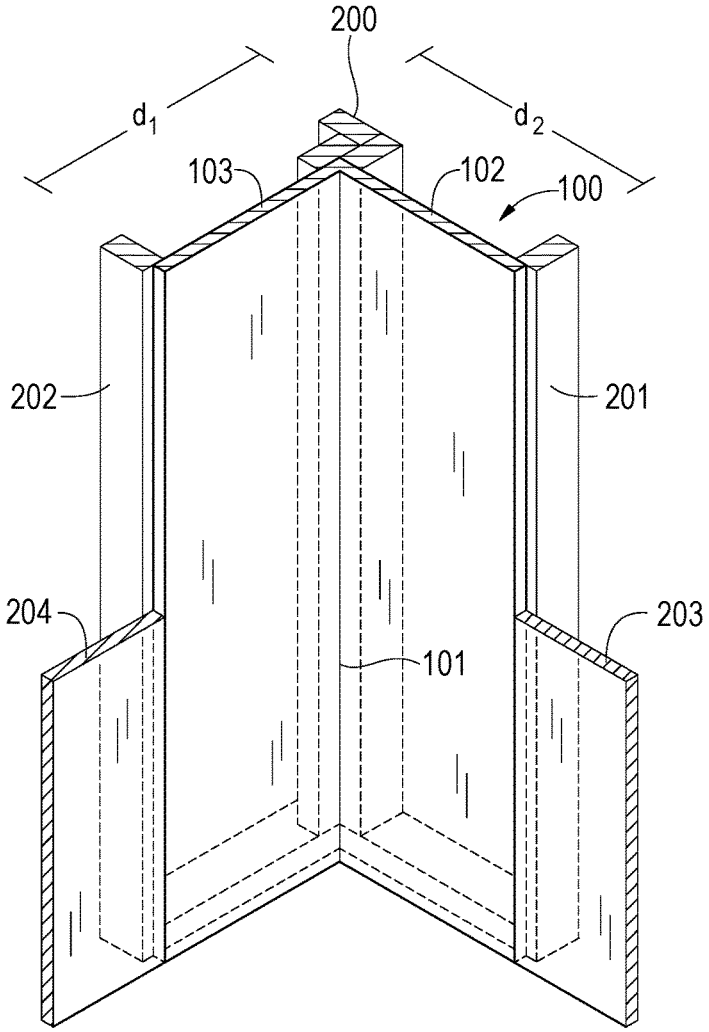
FIG. 2 is a perspective view of an exemplary inner corner drywall insert as shown in FIG. 1 installed on studs.
Figure 3:
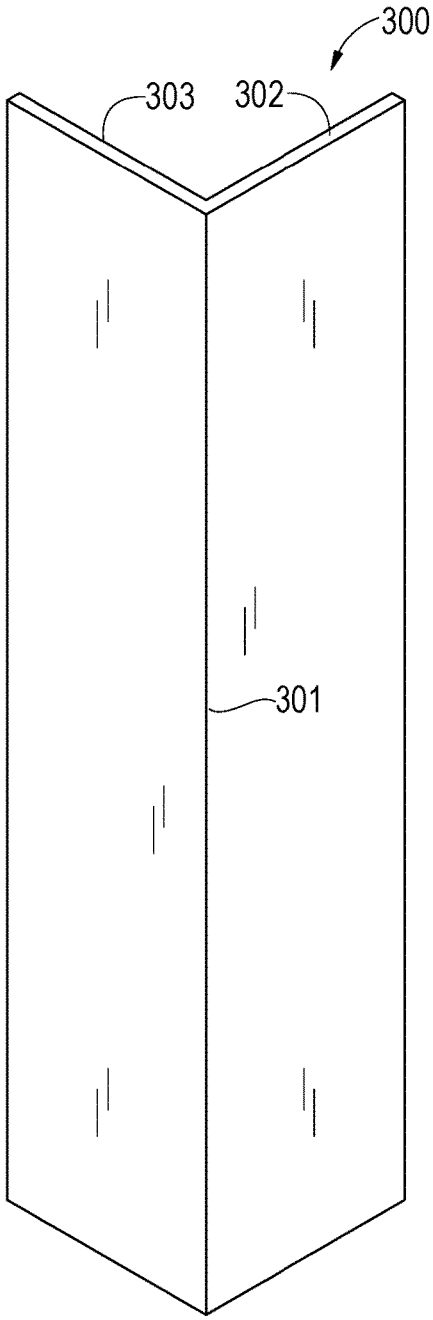
FIG. 3 is a perspective view of an exemplary outer corner drywall insert in accordance with an embodiment of the present disclosure.

FIG. 2 is a perspective view of the drywall insert 100 installed on a corner of room (not shown). In this regard, the drywall insert 100 has the wings 102 and 103 that extend at ninety degree angles from the corner 101 of the drywall insert 100.

The drywall insert 100 is secured to a corner wall structure 200. The corner wall structure 200 may be one or more pieces of wood. For example, the corner wall structure may be comprised of a plurality of two-by-fours.

Additionally, wing 103 extends from the corner wall structure 200 and corner 100 to a wall stud 202. Thus, the wing 103 may be secured to the wall stud 202 via a fastener, e.g., drywall screws or drywall nails. Once installed, another sheet of drywall 204 may be installed beside the wing 103.

The wing 102 extends from a corner wall structure 200 and corner 100 to a wall stud 201. Thus, the wing 102 may be secured to the wall stud 201 via a fastener, e.g., drywall screws or drywall nails. Once installed, another sheet of drywall 203 may be installed beside the wing 102.

Note that the wings 102 and 103 are a length $d_1$ and $d_2$. The measurements $d_1$ and $d_2$ are determined by a location of the wall studs 201 and 202. That is, the wings 102 and 103 have sufficient width such that the wings 102 and 103 extend from the corner 101 to the stud 201. In one embodiment, the length $d_1$ and $d_2$ are sixteen inches. However, this is merely exemplary. The wings 102 and 103 may be other widths in other embodiments depending upon the application. For example, the studs 201 and 202 may extend twenty-four inches from the corner 101. In such a scenario, the wings 102 and 103 are twenty-four inches in width.

FIG. 1 is a perspective view of an outer corner drywall insert 300 in accordance with an embodiment of the present disclosure. The outer drywall insert is made of paper-wrapped gypsum. However, it could be made of other materials in other embodiments.

The outer corner drywall insert 300 comprises two wings, including wing 303 and wing 302. The wings 303 and 302 extend at a right angle from a corner 301 of the outer corner drywall insert 300. Note that while the wings 303 and 302 extend ninety degrees from the corner 301, this is merely exemplary. The wings 303 and 302 could extend from the corner 301 at other angles in other embodiments where a corner dictates a different angle.

Figure 4:
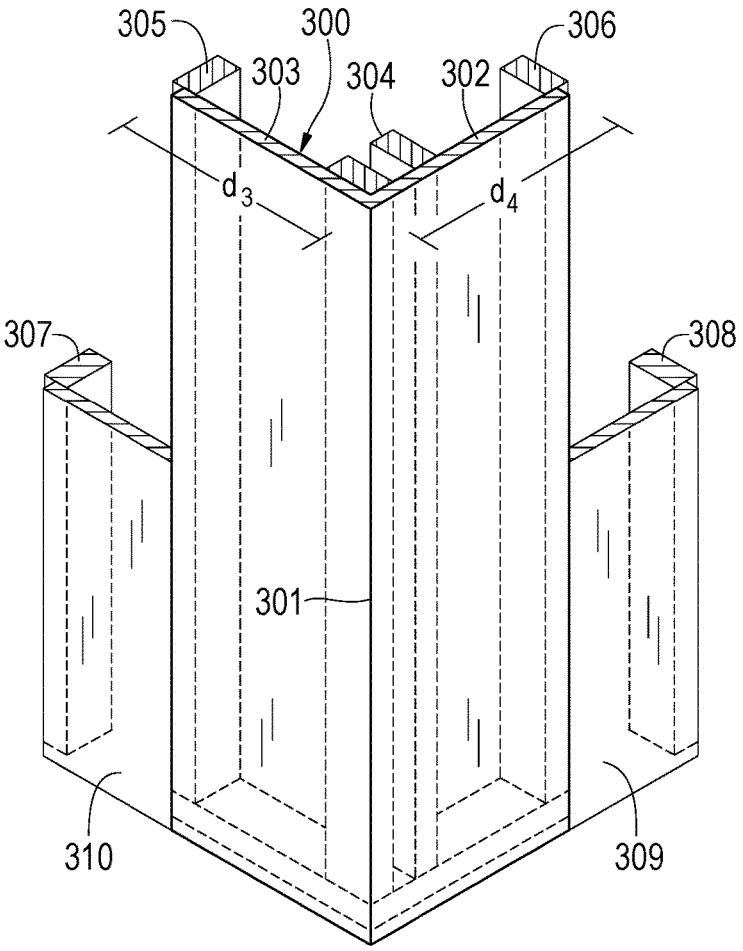
FIG. 4 is a perspective view of an exemplary outer corner drywall insert shown in FIG. 3 installed on studs.

FIG. 4 is a perspective view of the outer corner drywall insert 300 installed on a corner of room (not shown). In this regard, the outer corner drywall insert 300 has the wings 302 and 303 that extend at ninety degree angles from the corner 301 of the outer corner drywall insert 300.

Additionally, wing 302 extends from a corner wall structure 304 and corner 301 to a wall stud 306. Thus, the wing 302 may be secured to the wall stud 306 via a fastener, e.g., drywall screws or drywall nails. Once installed, another sheet of drywall 309 may be installed beside the wing 302 and coupled to wall stud 308.

The wing 303 extends from a corner wall structure 304 and corner 301 to a wall stud 305. Thus, the wing 303 may be secured to the wall stud 305 via a fastener, e.g., drywall screws or drywall nails. Once installed, another sheet of drywall 310 may be installed beside the wing 303 and coupled to wall stud 307.

Note that the wings 302 and 303 are a length $d_3$ and $d_4$. The measurements $d_3$ and $d_4$ are determined by a location of the wall studs 305 and 306. That is, the wings 302 and 302 have sufficient width such that the wings 302 and 303 extend from the corner 301 to the studs 306 and 306. In one embodiment, the length $d_3$ and $d_4$ are sixteen inches. However, this is merely exemplary. The wings 302 and 303 may be other widths in other embodiments depending upon the application. For example, the studs 306 and 305 may extend twenty-four inches from the corner 301. In such a scenario, the wings 302 and 303 are twenty-four inches in width.

FIG. 5 is a ceiling corner drywall insert 500. The ceiling corner drywall insert 500 is inserted in a ceiling corner prior to drywalling so that the drywall person does not have to tape and mud the ceiling corner. The corner drywall insert 500 is a single piece in one embodiment. However, it may be installed in more than one piece in other embodiments.

The ceiling corner drywall insert 500 comprises a corner 504. The corner 504 of the ceiling corner drywall insert 500 extends from the bottom of the ceiling corner drywall insert 500 to the top corner of the ceiling corner drywall insert 500.

Extending at ninety degrees from the corner 504 are wings 502 and 503. Note that while ninety degrees is shown, the wings 502 and 503 may extend from the corner 504 at other angles in other embodiments.

Additionally, the ceiling corner drywall insert 500 has a topmost section 501. The topmost section 501 is substantially square and coupled at a ninety degree angle to the wing 502 and the wing 503. The topmost section 501 is designed and configured to be a part of the ceiling (not shown) in a room.

Note that wings 502 and 503, corner 504 and topmost piece 501 are unitary. That is, the ceiling corner drywall insert 500 is one unitary piece.

FIG. 6 is a bottom perspective view of the ceiling corner drywall insert 500. The topmost piece 501 couples to the wings 502 and 503 along edges 600 and 601, respectively.

The wings 502 and 503 extend outward at a ninety degree angle from the corner 504. Note that while ninety degrees is shown, other angles may be used in other embodiments depending upon the application.

FIG. 7 is a perspective view of the ceiling corner drywall insert 500 installed. In this regard, the topmost section 501 is coupled to a standard support joist 700. The wings 502 and 503 extend outwardly at a ninety degree angle and extend far enough to couple to studs 505 and 506.

Note that the wings 502 and 503 are a length $d_5$ and $d_6$, respectively. The measurements $d_5$ and $d_6$ are determined by a location of the wall studs 505 and 506. That is, the wings 502 and 503 have sufficient width such that the wings 502 and 503 extend from the corner 504 to the studs 505 and 506.

In one embodiment, each of the lengths $d_5$ and $d_6$ is sixteen inches. However, this is merely exemplary. The wings 502 and 503 may be other widths in other embodiments depending upon the application. For example, the studs 505 and 506 may extend twenty-four inches from the corner 504. In such a scenario, each of the wings 502 and 503 are twenty-four inches in width.

The invention claimed is:

1. A corner drywall section, comprising:

a drywall corner extending vertically from a floor to a ceiling;

a first wing integral and unitary with the drywall corner and extending from a first side of the drywall corner at a first angle such that the first wing extends horizontally to a first stud, the first wing extending vertically from the floor to the ceiling and is immovable with respect to the drywall corner;

a second wing integral and unitary with the drywall corner and extending from a second side of the drywall corner at a second angle such that the second wing extends horizontally to a second stud, the second wing extending vertically from the floor to the ceiling and is immovable with respect to the drywall corner;

a substantially rectangular ceiling drywall section and a first side of the rectangular ceiling drywall section is unitary and formed with the first wing and a second side the second side of the rectangular ceiling drywall section is unitary and formed with the second wing, wherein the corner drywall section, the first wing, the second wing, and the substantially rectangular ceiling drywall section are unitary and form a single component all made of drywall.

2. The drywall corner section of claim 1, wherein the first wing and the second wing are substantially rectangular.

3. The corner drywall section of claim 1, wherein the first angle extends at a right angle from the drywall corner.

4. The corner drywall section of claim 1, wherein the second angle extends at a right angle from the drywall corner and doesn't have a hinge.

5. The corner drywall section of claim 1, wherein a wall board used for covering walls and ceilings is coupled to the first stud after the first wing is coupled to the first stud.

6. The corner drywall section of claim 1, wherein a wallboard used for covering walls and ceilings is coupled to the second stud after the second wing is coupled to the second stud.

7. The corner drywall section of claim 1, wherein a width of the first wing depends upon a location of the first stud.

8. The corner drywall section of claim 1, wherein a width of the second wing depends upon a location of the second stud.

9. The corner drywall section of claim 1, wherein the drywall corner is secured to a corner wall structure.

10. The corner drywall section of claim 9, wherein the corner wall structure comprises one or more pieces of wood.

11. The corner drywall section of claim 10, wherein the pieces of wood are two-by-fours.

12. The corner drywall section of claim 1, further comprising a ceiling section.

13. The corner drywall section of claim 1, wherein the drywall is paper-wrapped gypsum.

14. The corner drywall section of claim 1, wherein the drywall is plasterboard.

15. The corner drywall section of claim 1, wherein the drywall is sheetrock.

* * * * *